US006658696B2

(12) United States Patent
Buckelew

(10) Patent No.: US 6,658,696 B2
(45) Date of Patent: Dec. 9, 2003

(54) DOOR HINGE MOUNTED CONTAINER HOLDER

(76) Inventor: Louis Nick Buckelew, HC 2, Box 6910, Tucson, AZ (US) 85735

( * ) Notice: Subject to any disclaimer, the term of this patent is extended or adjusted under 35 U.S.C. 154(b) by 0 days.

(21) Appl. No.: 10/043,966

(22) Filed: Jan. 9, 2002

(65) Prior Publication Data

US 2002/0056172 A1 May 16, 2002

(51) Int. Cl.[7] ..... E05F 5/02

(52) U.S. Cl. ..... 16/82; 16/223; 16/86 B; 16/86 R; 211/119.004

(58) Field of Search ..... 16/223, 252, 253, 16/82, 86 R, 86 A, 86 B, 355, 356; 211/119.004; 220/475, 509, 737

(56) References Cited

U.S. PATENT DOCUMENTS

| | | | | |
|---|---|---|---|---|
| 2,509,502 A | | 5/1950 | Hunt | |
| 2,813,293 A | * | 11/1957 | Civitelli | 16/375 |
| 3,043,523 A | | 7/1962 | Hogstrom | |
| 3,044,630 A | | 7/1962 | Szabo | |
| 3,224,644 A | * | 12/1965 | Davis | 222/162 |
| 3,805,732 A | | 4/1974 | Reed | |
| 4,259,762 A | * | 4/1981 | Civitelli | 16/86 B |
| 4,454,966 A | * | 6/1984 | Hicks | 222/153.11 |
| 4,527,303 A | * | 7/1985 | Civitelli | 16/86 B |
| 5,392,975 A | * | 2/1995 | Blankenship, Jr. | 224/148.5 |
| 5,505,317 A | * | 4/1996 | Rulis et al. | 211/119.004 |
| 5,531,344 A | | 7/1996 | Winner | |
| 5,531,359 A | * | 7/1996 | Winner | 222/153.11 |
| 5,644,297 A | | 7/1997 | Masi et al. | |
| 5,992,094 A | | 11/1999 | Diaz | |
| 6,145,654 A | * | 11/2000 | Loghman | 206/37 |
| 6,193,084 B1 | * | 2/2001 | Oliver | 211/119.004 |

* cited by examiner

*Primary Examiner*—Gary Estremsky
*Assistant Examiner*—Mark Williams
(74) *Attorney, Agent, or Firm*—Birdwell, Janke & Durando, PLC

(57) ABSTRACT

A door hinge mounted container holder. A body portion is adapted to loosely receive a container such as a spray can of mace. The body portion is adapted for attachment to a door hinge, and preferably includes a pair of door stops to prevent the door from opening so far that a person cannot easily access the container.

9 Claims, 3 Drawing Sheets

Fig. 1A
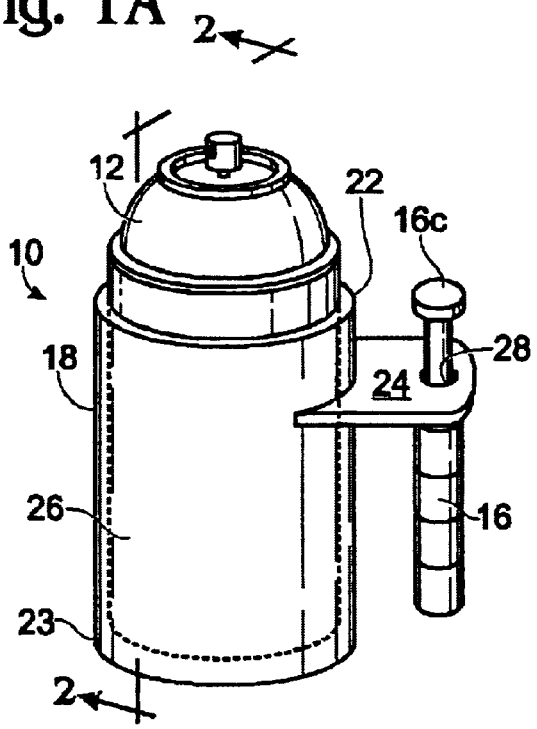
Fig. 2
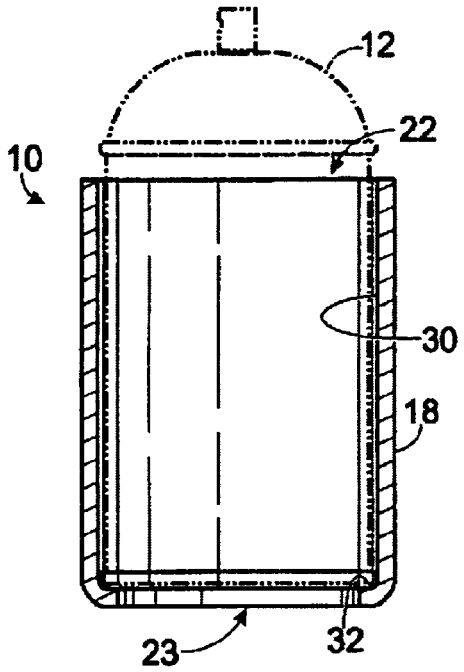
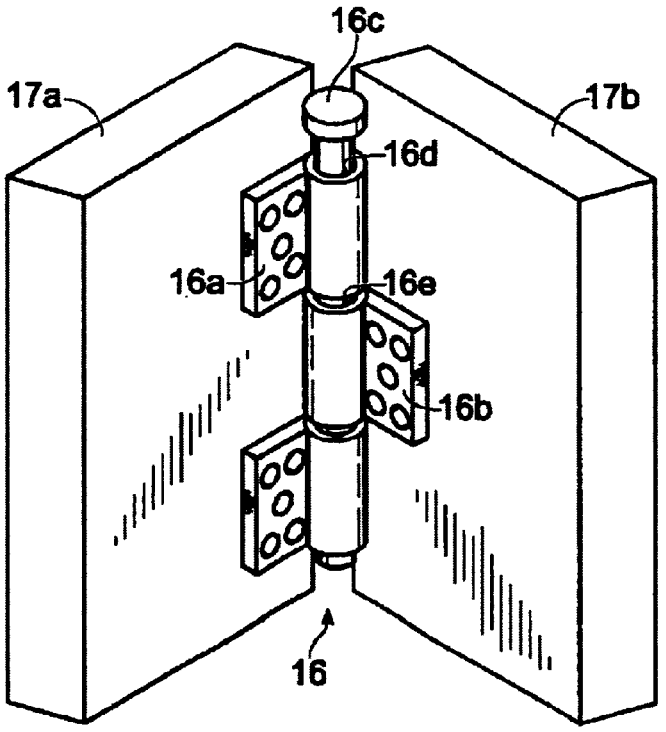
Fig. 1B

DOOR HINGE MOUNTED CONTAINER HOLDER

FIELD OF THE INVENTION

This invention relates to a door hinge mounted container holder for providing easy access to a container, such as a mace container, particularly for mounting such a container by a door for easy access when opening the door.

BACKGROUND OF THE INVENTION

Crimes against persons are of growing concern. Many people feel safer when they have access to spray cans containing repelling substances such as mace or pepper solution. As a consequence, mace and pepper spray cans are increasingly popular. Frequently, people carry such spray cans in a purse, bag, or on a key chain, for use while traveling. However, they do not usually carry these items while at home. It may be necessary to use such a weapon when a threatening person is at the front door, or when an intruder is in the home and chases someone into a room. It is therefore desirable to be able to quickly and easily obtain access to a mace or pepper spray can while in the home.

U.S. Pat. No. 3,043,523 discloses a device for holding a deodorizing spray can that is operated by opening a door. A spray can is securely mounted to a bracket which is connected to two hinge plates. The hinge plates are secured to the hinge between the door and the wall by a hinge pin. The disadvantage of this device is that the spray can is firmly grasped by the holding device and parts of the device must be repositioned in order to remove the can, making retrieval in an emergency difficult. In addition, every time the door is opened the spray can is activated, which is not desirable when using a spray can with a repelling substance.

U.S. Pat. No. 3,805,732 discloses a combined intruder repellent and burglar alarm that is mounted above a door. When an intruder opens the door, an actuator releases a gas and activates an audible alarm signal. A disadvantage of this device is that, in order to function, the intruder must be standing in a limited area. Moreover, unless it is used with a safety device, an occupant of the house may forget that the device is activated and may accidently get sprayed by the device.

U.S. Pat. No. 5,531,344 discloses an electrical actuator device for use with a spray can containing a repelling substance. The spray can is mounted outside a house, and a person actuates the spray can from inside the house. Disadvantages of this device are that the spray can is visible to a potential intruder outside so that it is accessible for deactivation, the potential intruder must be standing near the spray can for it to be effective, and the device is costly to manufacture.

Therefore, there is a need to provide a door hinge mounted container holder that is not visible to an intruder, that does not require any repositioning when retrieving the spray can, that does not trigger the spray can at undesirable times, that is not susceptible to deactivation by an intruder, and that is easy to manufacture.

SUMMARY OF THE INVENTION

The door hinge mounted container holder of the present invention solves the aforementioned problems and meets the aforementioned needs by providing a housing having a body portion adapted to loosely receive a container such as a spray can of mace. The body portion is adapted for attachment to a door hinge and preferably includes a pair of door stops projecting therefrom. The door stops prevent the door from opening so far that a person cannot easily access the container.

Therefore, it is a principle object of the present invention to provide a novel and improved door hinge mounted container holder which is not visible to an intruder.

It is another object of the present invention to provide a door hinge mounted container holder that does not require repositioning of the parts in order to retrieve the spray can.

It is yet another object of the present invention to provide a door hinge mounted container holder that does not trigger at undesirable times.

It is a further object of the present invention to provide a door hinge mounted container holder that is easy to manufacture.

It is yet a further object of the present invention to provide a door hinge mounted container holder that is not susceptible to deactivation by an intruder.

BRIEF DESCRIPTION OF THE DRAWINGS

FIG. 1A is a pictorial view of a first embodiment of a door hinge mounted container holder according to the present invention.

FIG. 1B is a pictorial view of a door hinge onto which the door hinge mounted container holder of FIG. 1A may be mounted.

FIG. 2 is a cross-sectional view of the door hinge mounted container holder of FIG. 1A, taken along a line 1—1 with the profile of the container shown in phantom lines.

DETAILED DESCRIPTION OF THE INVENTION

Figure 3:
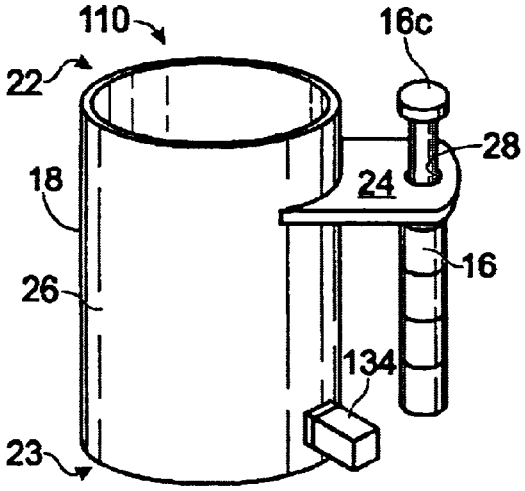
FIG. 3 is a pictorial view of a second embodiment of a door hinge mounted container holder according to the present invention.

A first embodiment 10 of a door hinge mounted container holder according to the present invention is shown in FIG. 1A. FIG. 1A shows the holder 10 holding a container 12 that may contain a repellent such as mace. However, the holder 10 may be used for holding any desired container that may contain any desired substance, including solid particles, without departing from the principles of the invention. As shown in FIG. 1B, the holder is adapted for attachment to a door hinge 16, the hinge typically comprising hinge portions 16*a* and 16*b*, one being attached to the door 17*a* and the other being attached to the door jamb 17*b*, and being coupled together by use of a hinge pin 16*c* being inserted through respective apertures 16*d* and 16*e* thereof.

The container holder 10 includes a body portion 18, preferably formed of a substantially cylindrically shaped tube. The tube has an open end 22 for loosely receiving the container 12, and an opposite end 23 which may be open as well. The holder 10 is adapted, however, so that the intended container 12 will not fall through the end 23, when the body is oriented as shown in FIG. 1A, as described below. While a tubular structure is preferably employed as the body 18, any alternative structure that permits loosely receiving the container 12 may be employed as well, including such alternatives that do not completely surround the container 12.

Turning to FIG. 2, illustrating the holder 10 in cross-section, the end 23 is preferably crimped to form a lip 32 that serves the aforementioned purpose of supporting the container 12. Particularly, the lip 32 extends around the circumference of the inside wall 30 and creates a smaller diameter portion of the body 18 so that, when the container 12 is inserted into the holder, it rests on the lip 32, rather than falling through the end 23.

To permit attachment of the holder 10 to a door hinge, an attachment member 24 extends from an outside wall 26 of the body 18. An aperture 28 extends through the attachment member 24 for alignment with the apertures 16*d* and 16*e* in the door hinge 16. The attachment member 24 is shown in FIG. 1A as being a tab, but other attachment member structures, such as a projecting ring, can be used without departing from the principles of the invention.

A second embodiment 110 of a door hinge mounted container holder according to the present invention is shown in FIGS. 3–4. The second embodiment is similar to the first embodiment and like parts are given the same number. An additional feature of this embodiment is that the container holder 110 has a pair of door stops 134 and 136 positioned approximately 90 degrees from each other around the circumference of the outside wall 26 of the container holder 110. The door stops provide the additional feature of preventing the door from opening so far that access to the container 12 becomes difficult or impossible. Particularly, the door stops make contact with the door and door jamb to stop the opening of the door beyond a predetermined angle of access as discussed below.

The door stops are preferably formed of or include a plastic or rubber material to cushion contact with the door and the doorjamb, preferably so that neither is marked. The door stops may be attached to the container holder 110 by an adhesive. However, the door stops can be made from other materials and attached to the container holder by alternative means without departing from the principles of the invention. For example, the body 18 can be integrally formed with the door stops 134 and 136, and the door stops can be coated with a cushioning material. Also, one or both door stops may be omitted, and the body 18 may be adapted in size or shape to serve the function of providing a door stop.

Figure 4A:
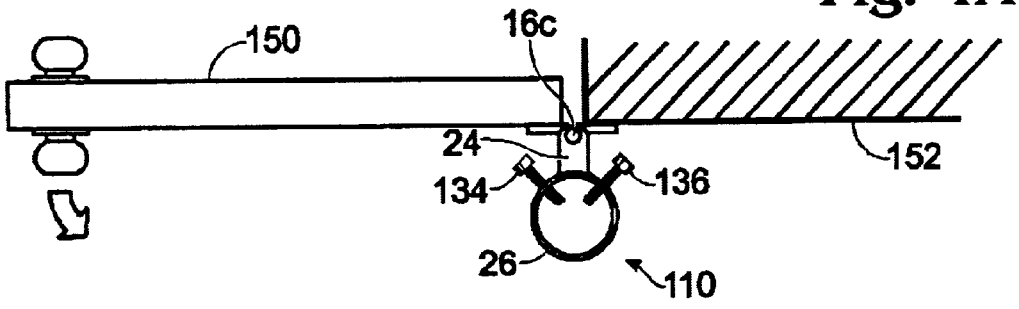
FIGS. 4A–4C are plan schematic views of the door hinge mounted container holder of FIG. 3, showing stages of opening a door.
Figure 4B:
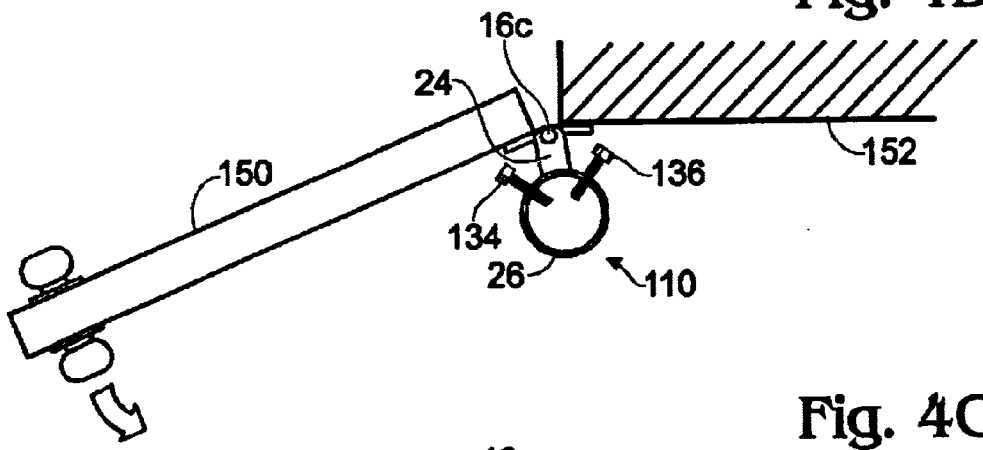
Figure 4C:
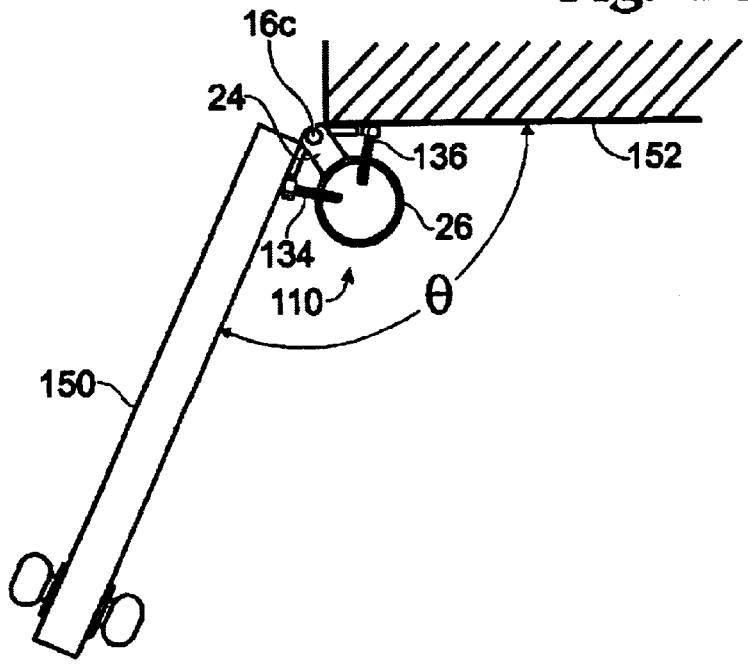

FIGS. 4A–4C show how the container holder 110 acts as a door stop. In FIG. 4A, the container holder 110 is attached to a hinge assembly between a closed door 150 and a doorjamb (or wall) 152. The hinge pin 16*c* forms a pin joint. FIG. 4B shows the door 150 as it is being opened, the container holder 110 may or may not rotate along with the door hinge. In FIG. 4C, the door 150 is opened to a minimum access angle θ formed between the door and the door jamb 152, which is as far as it can be opened due to the door stops 134 and 136. The angle θ is selected to permit opening the door a sufficient amount for use as an entry or exit, but also to permit a person to access the holder 110 and the container 12. Since the door typically opens to the interior of the room in which it is hung, the hinge pin aperture is in the inside of the room, thus preventing a potential intruder or other person from disabling it.

Figure 5:
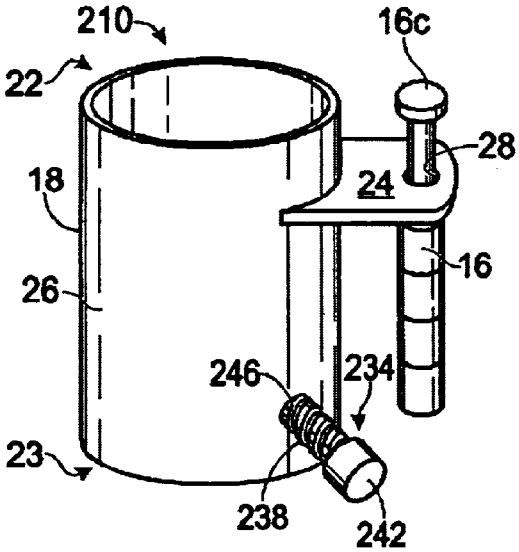
FIG. 5 is a pictorial view of a third embodiment of a door hinge mounted container holder according to the present invention.
Figure 6:
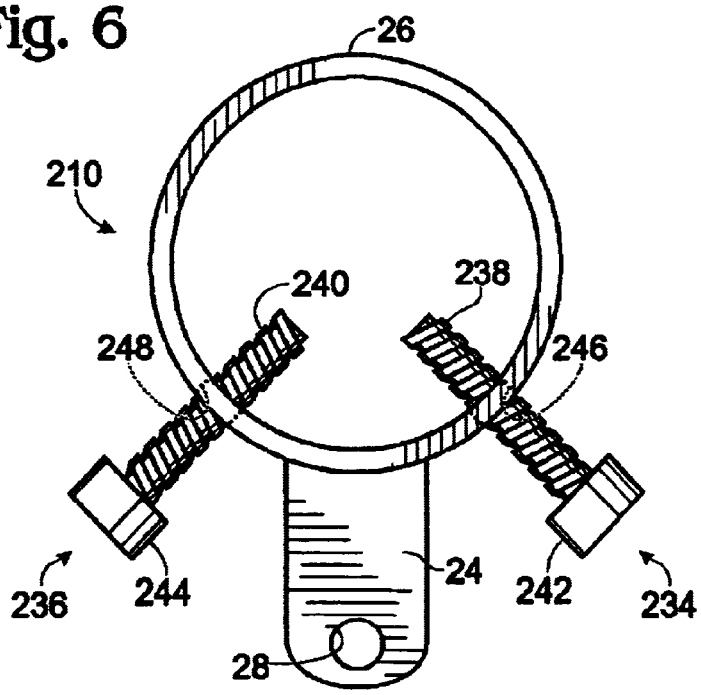
FIG. 6 is a top view of the door hinge mounted container holder of FIG. 5.

A third embodiment 210 of a door hinge mounted container holder according to the present invention is shown in FIGS. 5–6. The third embodiment is similar to the other embodiments and like parts are given the same number. The third embodiment is different from the second embodiment in that it has door stops whose length can be adjusted, so that the amount that the door can be opened can be varied. The doors stops 234 and 236 have threaded portions 238 and 240 that are connected to knob portions 242 and 244. Threaded apertures 246 and 248 are made in the outside wall 26 through to the inside wall of the container holder 210. The threaded portions of 238 and 240 of the door stops 234 and 236 are threaded through the apertures 246 and 248, respectively. In order to decrease the amount that the door can be opened, the door stops 234 and 236 are unthreaded so that the knob portions 242 and 244 extend further out from the outside wall 26. In order to increase the amount that the door can be opened, the door stops 234 and 236 are threaded in further, and the amount that the knob portions 242 and 244 extend from the outside wall 26 is decreased.

Referring to FIG. 6, another feature of the door stops 234 and 236 is that they may be used, instead of any other means, to support the container 12 (not shown in FIG. 6 for clarity). Particularly, when the container is placed in the holder 210, it rests on the threaded portions 238 and 240 of the door stops 234 and 236. The door stops 234 and 236 in FIGS. 5 and 6 are preferably formed of metal for durability, and the knob portions 242 and 244 are covered with a cushioning material, but other materials can be used without departing from the principles of the invention.

Returning to FIGS. 1A and 1B, in order to install and use the hinge mounted container holder 10, the aperture 28 in the attachment member 24 is aligned with apertures 16*d* and 16*e* in the top of the door hinge 16. The hinge pin 16*c* is inserted through the aperture 28 in the attachment member 24 and into the apertures 16*d* and 16*e* of the door hinge 16 in order to secure the container holder to the door hinge. A container 12, such as a spray can of mace, is placed into the holder 10. When someone arrives at the door, the container 12 can be reached and removed before the door is opened. Alternatively, if the door is opened, a person can place his or her arm between the door and the wall to quickly retrieve the container. A hinge mounted container holder according to the present invention can be mounted to the door hinge in every room in the house to ensure safety in all parts of the home.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A door hinge mounted container holder assembly, comprising:

a container for containing a repelling substance;

a body having a wall portion formed into a substantially cylindrical, hollow shape with open ends, wherein one of said open ends of said wall portion includes a lip extending inwardly from said wall portion, said container adapted to rest on said lip; and an attachment member extending from said body portion and attached to the door hinge.

2. The assembly of claim 1, further comprising at least one door stop extending from said body for stopping the door when it is opened.

3. The assembly of claim 1, comprising a pair of stops extending from said container for making contact with a door and a door jamb, respectively, to which the hinge is attached.

4. A door hinge mounted container holder mounted to a hinge assembly for a door, the hinge assembly having two hinge portions for attachment to the door and to a door jamb, respectively, and a hinge pin forming a pin joint for said hinge portions, the holder comprising:

a tubular body defining an elongate axis for receiving the container along said axis;

a tab extending from said body and having an aperture therethrough for receiving the hinge pin along the same direction as said axis; and a first door stop having a threaded member and adapted for making contact with one of the door and the doorjamb as a result of opening the door, wherein said body includes a first threaded aperture for threadably receiving said member so that the position of said first door stop is radially adjustable, to vary the position at which the door is stopped wherein said first threaded aperture is through a lower portion of said body when said body is mounted to the hinge assembly, so that said threaded member provides a surface to support the container.

5. The holder of claim 4, further comprising a second door stop having a threaded member, wherein said body includes a second threaded aperture for threadably receiving said member of said second door stop so that the position of said second door stop is radially adjustable, wherein said door is stopped by one of said first and second door stops making contact with the door and the other of said first and second door stops making contact with the door jamb.

6. The holder of claim 5, wherein said first door stop is received by said body along a first radial axis, and wherein said second door stop is received by said body along a second radial axis that is substantially perpendicular to said first radial axis.

7. A door hinge mounted container holder mounted to a hinge assembly for a door, comprising:

a body having a wall portion formed into a substantially cylindrical, hollow shape with open ends, wherein one of said open ends of said wall portion includes a lip extending inwardly from said wall portion, the container adapted to rest on said lip; and a tab extending from said body portion and having an aperture therethrough for alignment with an aperture in the door hinge so that a pin can be inserted into said apertures to mount said holder on the door hinge.

8. The holder of claim 7, comprising at least one door stop extending from said body for stopping the door when it is opened.

9. The holder of claim 7, comprising a pair of door stops extending from said body for making contact with a door and a door jamb, respectively to which the hinge is attached.

* * * * *